US007837062B2

(12) United States Patent
Pronschinske et al.

(10) Patent No.: US 7,837,062 B2
(45) Date of Patent: Nov. 23, 2010

(54) AIR CANNON FOR REMOVAL OF FLOWABLE MATERIAL FROM A MATERIAL HANDLING SYSTEM

(75) Inventors: Bradley E. Pronschinske, Kewanee, IL (US); Michael J. Masterson, Bradford, IL (US); Travis J. Miller, Annawan, IL (US)

(73) Assignee: Martin Engineering Company, Neponset, IL (US)

( * ) Notice: Subject to any disclaimer, the term of this patent is extended or adjusted under 35 U.S.C. 154(b) by 0 days.

(21) Appl. No.: 12/179,283

(22) Filed: Jul. 24, 2008

(65) Prior Publication Data

US 2009/0001097 A1 Jan. 1, 2009

Related U.S. Application Data

(63) Continuation-in-part of application No. 11/684,278, filed on Mar. 9, 2007.

(60) Provisional application No. 60/781,058, filed on Mar. 10, 2006.

(51) Int. Cl.
*B67D 7/00* (2010.01)

(52) U.S. Cl. ..... 222/3; 222/195

(58) Field of Classification Search ..... 222/3, 222/195, 630; 366/106, 107; 406/85, 136, 406/137

See application file for complete search history.

(56) References Cited

U.S. PATENT DOCUMENTS 3,788,527 A * 1/1974 Matson ..... 222/195
3,915,339 A * 10/1975 Matson ..... 222/3
4,469,247 A 9/1984 Tompkins (Continued)

FOREIGN PATENT DOCUMENTS

DE 20316754 U1 2/2004

(Continued)

OTHER PUBLICATIONS

EPO translation of EP 1528013 A1.*

(Continued)

*Primary Examiner*—Kevin P Shaver
*Assistant Examiner*—Daniel R Shearer
(74) *Attorney, Agent, or Firm*—Thompson Coburn LLP; Clyde L. Smith

(57) ABSTRACT

An air cannon or aerator has a first source of a pressurized gas, such as a tank, a discharge tube assembly, a valve assembly configured to regulate the flow of pressurized gas from the tank to the discharge tube assembly, and a receiving member or basket having a first end configured to receive and seat the valve assembly and a second end configured to releasably and securely mate with the discharge tube assembly. The discharge tube assembly, valve assembly, and basket are all concentrically aligned along a central, longitudinal axis extending substantially coaxial with the longitudinal center line of the tank. The positioning of the discharge tube assembly and valve assembly close to a longitudinal center line of the tank, thereby providing for a central location for the energy discharge, and the provision of large ports in the basket facilitating substantially unobstructed fluid communication between the tank and discharge tube assembly, together facilitate smooth discharge of the pressurized gas as well as increased efficiency and force output of the air cannon.

4 Claims, 19 Drawing Sheets

U.S. PATENT DOCUMENTS

| | | | | |
|---|---|---|---|---|
| 4,496,076 | A | 1/1985 | Tompkins | |
| 4,676,402 | A | 6/1987 | Stetson | |
| 4,703,869 | A * | 11/1987 | De Rooy | 222/3 |
| 5,002,154 | A | 3/1991 | Chen | |
| 5,143,256 | A * | 9/1992 | Wadensten | 222/3 |
| 6,056,007 | A | 5/2000 | Gochenouer et al. | |
| 6,557,902 | B1 | 5/2003 | Einsiedel et al. | |
| 2003/0132241 | A1 | 7/2003 | Treat | |
| 2005/0151100 | A1 | 7/2005 | Dalmasso et al. | |
| 2007/0209648 | A1 | 9/2007 | Pronschinske et al. | |

FOREIGN PATENT DOCUMENTS

| | | | |
|---|---|---|---|
| EP | 0097236 | A1 | 5/1983 |
| EP | 0202720 | | 11/1986 |
| EP | 246617 | | 11/1987 |
| EP | 1528013 | A1 * | 5/2005 |
| EP | 1528013 | B1 | 6/2006 |

OTHER PUBLICATIONS

International Search Report for International Patent Application No. PCT/US2007/063769, mailed Oct. 19, 2007, 5 pages.

Written Opinion of the International Searching Authority for International application No. PCT/US2007/063769, mailed on Oct. 19, 2007, 5 pages.

International Search Report for International Patent Application No. PCT/US2007/063769, mailed Oct. 19, 2007, 5 pages.

Written Opinion of the International Searching Authority for International application No. PCT/US2007/063769, mailed on Oct. 19, 2007, 5 pages.

English abstract of EP Patent No. 246617 issued on Nov. 25, 1987, 1 page.

GLOBAL's Patented "Direct Blast", Product Brochure, Published before Mar. 9, 2005, 1 page.

Effect of the BIG BLASTER® air cannons, Product Brochure, Published in July of 1989, 2 pages.

MARTIN® MINI-BLASTER Air Cannon Operator's Manual, Published before Mar. 9, 2005, 3 pages.

MARTIN® MINI-BLASTER Air Cannons, Technical Data Sheet, Published in November of 1993, 2 pages.

VIBCO'S AIR, Product Brochure, Published before Mar. 9, 2005, 1 page.

* cited by examiner

AIR CANNON FOR REMOVAL OF FLOWABLE MATERIAL FROM A MATERIAL HANDLING SYSTEM

CROSS-REFERENCE TO RELATED APPLICATIONS

This application is a continuation-in-part of application Ser. No. 11/684,278, filed on Mar. 9, 2007, which application claims the benefit of U.S. provisional patent Application Ser. No. 60/781,058, filed on Mar. 10, 2006, the entireties of which are hereby incorporated by reference.

FIELD OF THE INVENTION

The present invention relates to an air cannon or aerator for removal of flowable materials that has coagulated or caked in an area of a material handling system, the air cannon or aerator comprises components configured to facilitate ease of assembly and disassembly for maintenance and repair of the air cannon.

BACKGROUND OF THE INVENTION

The storage of granular and similar bulk materials in bins, silos and the like creates many problems, particularly in the discharge of such bulk material, as bulk material has the tendency to refuse to flow due to bridging and other problems. Air cannons are used in connection with the handling and aeration of bulk material. An air cannon stores a large volume of air or other gas under pressure in a pressure tank and then quickly releases the air instantaneously into the storage receptacle such that the blast of air causes any obstructing bulk material to dislodge, thereby enabling the bulk material to flow freely from the storage receptacle.

BRIEF SUMMARY OF THE INVENTION

The present invention is an air cannon comprising a source of pressurized gas, and a discharge member configured to direct a release of a volume of the pressurized gas towards a target. The discharge member has a longitudinal axis extending therethrough. A valve assembly, operatively associated with the source of pressurized gas and the discharge member, is also provided. The valve assembly is configured to control the release of the volume of pressurized gas from the source of pressurized gas to the discharge member. Moreover, the valve assembly has a discharge port coaxially aligned with the longitudinal axis of the discharge member.

In a preferred embodiment, a receiving member is configured to releasably mate with the discharge member and to be releasably received by the source of pressurized gas. The receiving member is further configured to receive the valve assembly and to coaxially align the valve assembly and the discharge member along the longitudinal axis of the discharge member. The receiving member includes at one inlet port facilitating fluid communication between the source of pressurized gas and the valve assembly. Further, in a preferred embodiment, the at least one inlet port comprises a plurality of inlet ports disposed circumferentially around an interface of the receiving member and the discharge member.

The valve assembly includes a discharge piston movable between a first, extended position and a second, retracted position. The source of pressurized gas is in direct fluid communication with the discharge member when the discharge piston is in the retracted position, and is in fluid communication with an actuator when the discharge piston is in the extended position.

The receiving member is configured to receive the valve assembly and coaxially align the valve assembly and discharge member along the longitudinal axis in response to an insertion force applied to the receiving member in a direction parallel to the longitudinal axis of the discharge member. Application of a force in a direction parallel to and opposite the insertion force decouples the receiving member from the discharge member and the source of pressurized gas.

In a preferred embodiment of the present invention, a pressure tank having a wall is provided. The wall has an aperture and a valve mechanism connector disposed at the aperture. A tube having a first end is provided, with at least a portion of the tube and the first end extending into the pressure tank, with the first end adjacent the aperture. A valve mechanism having a pressure tank connector and a tube connector is also provided. The pressure tank connector couples to the valve mechanism connector and the tube connector couples to the first end of the tube. The aperture and the valve mechanism connector collectively define a first longitudinal axis, and the tube defines a second longitudinal axis collinear to the first longitudinal axis.

The valve mechanism connector includes a recessed annular seat surrounded by an annular mounting flange, and the valve mechanism includes a main piston housing and a valve housing. The main piston housing has a collar to receive and couple to the first end of the tube, and the valve housing has an annular valve flange for mounting to the annular mounting flange.

Moreover, in a preferred embodiment of the present invention, a plurality of ports facilitating fluid communication between the source of pressurized gas and the discharge member is provided. The plurality of ports are configured to provide substantially obstructed fluid communication between the source of the pressurized gas and the discharge member. A basket is provided and is configured to receive the valve assembly and is further configured to mount to the discharge member and the source of pressurized gas. The basket has a first and second portion connected by a plurality of connecting members. The connecting members are disposed adjacent to and define at least a portion of boundary regions of the plurality of ports. Each port of the plurality of ports is substantially greater in surface area than the connecting members adjacent each port.

DETAILED DESCRIPTION OF THE INVENTION

Figure 1:
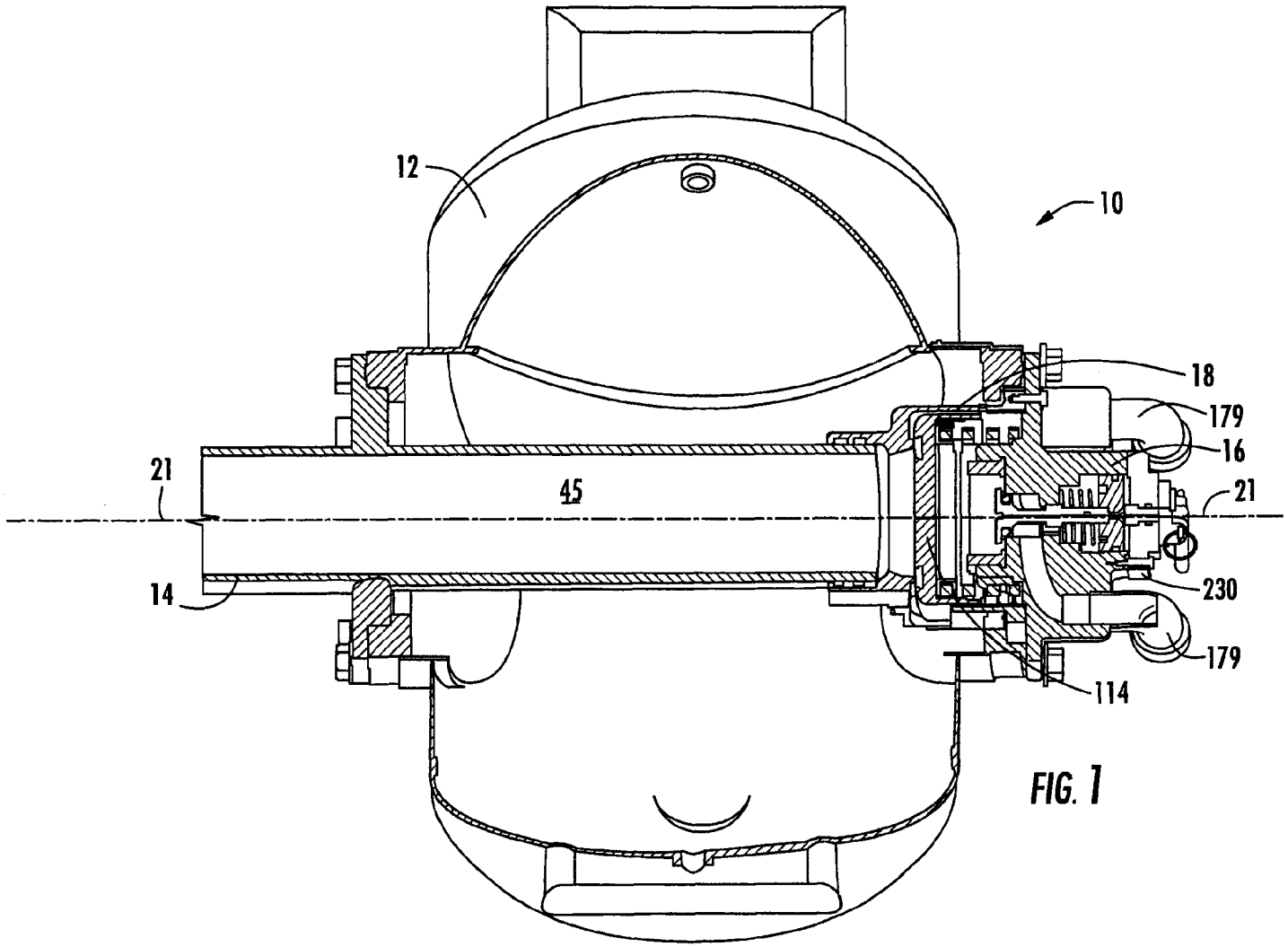
FIG. 1 is a partial cross-sectional view of the air cannon of the present invention, showing, in particular, the basket positioned in place.

FIGS. 1-24 show an air cannon 10 in accordance with the present invention. As is shown in FIG. 1, the air cannon 10 comprises a first source 12 of a pressurized gas, such as a tank, to be discharged by the air cannon 10, a discharge tube or blow tube assembly 14 for directing the pressurized gas towards a desired target or target area, a valve assembly 16 configured to regulate the flow of pressurized gas from the tank 12 to the discharge tube assembly 14, and a receiving member or basket 18 having a first end configured to receive and seat the valve assembly 16 and a second end configured to releasably and securely mate with the discharge tube assembly 14. The valve assembly 16 is releasably secured to the tank 12 to secure all components of the air cannon 10 in place.

The discharge tube assembly 14, valve assembly 16, and basket 18 are all concentrically aligned along a central, longitudinal axis 21. In one embodiment of the present invention, the valve assembly 16 comprises a discharge piston 114 and a positive pressure actuated aerator valve assembly such as the positive pressure actuated aerator valve described in U.S. Patent Publication No. US2005/0151100 of Martin Engineering Company, incorporated by reference herein, and described in detail below.

Figure 2:
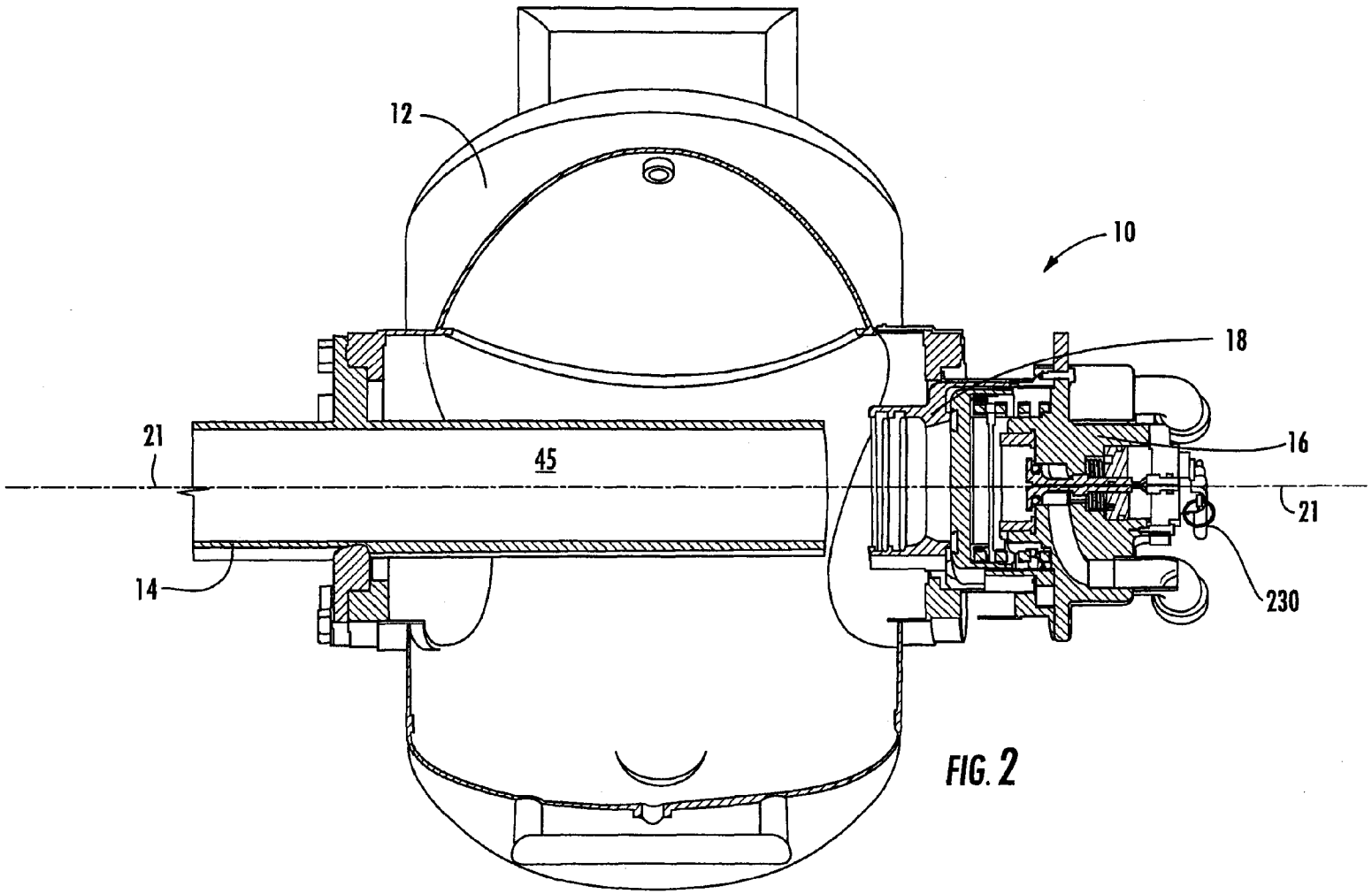
FIG. 2 is a partial cross-sectional view of the air cannon of the present invention, showing, in particular, the basket being removed from the remainder of the air cannon.
Figure 24:
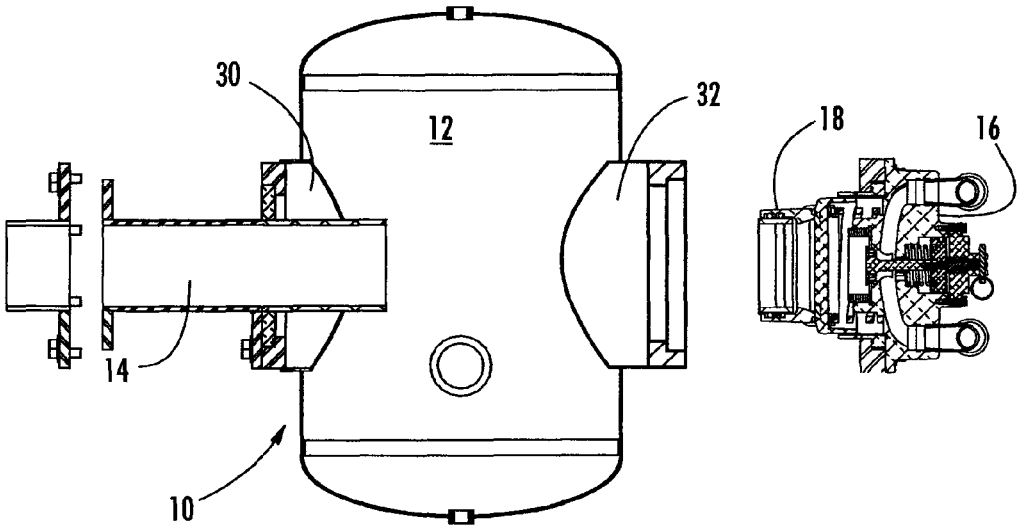
FIG. 24 is an exploded cross-sectional view of the air cannon of the present invention.
Figure 25:
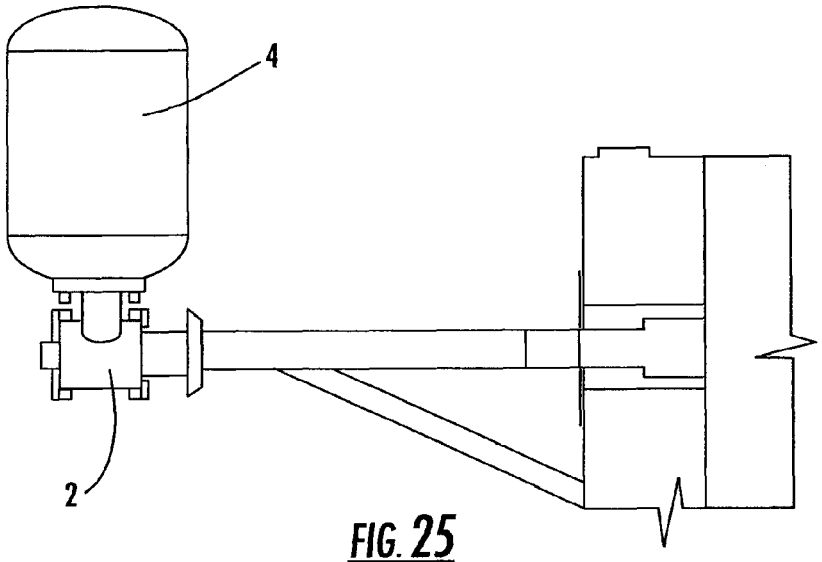
FIG. 25 (PRIOR ART)
FIG. 25 is a prior art air cannon, showing, in particular, the attachment thereof to a material handling system.

As is particularly shown in FIGS. 1, 2 and 24, attachment of the valve assembly 16 to the tank 12 and discharge tube assembly 14 is accomplished by coupling the basket 18 to the blow tube assembly 14 with an insertion direction that is coaxial with the longitudinal axis 21. Removal of the valve assembly 16 and basket 18 for maintenance or repair requires removal of the valve assembly 16 and basket 18 along the longitudinal axis 21 in a direction opposite the direction for attachment. In contrast, in prior art air cannons, such as the air cannon shown in FIG. 25, access to working components of the valve assembly 2 required disconnection and removal of the tank 4 from the air cannon assembly, adding to the time required to service the air cannon. The configuration of components in the present inventive air cannon enables the valve assembly 16 to be removed from the air cannon 10 without the need to disassemble the tank 12. The valve assembly 16 components are assembled and then inserted within the basket 18, such that the coupling of the basket 18 to the discharge tube assembly 14 properly aligns the fluid ports and chambers of the tank 12, discharge tube assembly 14 and valve assembly 16.

Referring to FIGS. 3-24, in one embodiment of the present invention, the tank 12 is a refillable tank for holding a pressurized gas, such as air. The tank 12 comprises a first and second end portion spaced apart and interconnected by a cylindrical sidewall to form an interior chamber. The first end portion may also comprise a valve for refilling the interior chamber with pressurized gas. The sidewall comprises a first and second collar 30, 32, diametrically spaced apart on the sidewall. The first collar 30 is configured to receive and enable passage therethrough of the discharge tube assembly 14. The second collar is configured to receive the basket 18 and releasably mate with valve assembly 16.

The second collar 32 comprises a first cylindrical member having a first and second end, wherein the first end extends through the sidewall from the interior chamber to the exterior of the tank 12. At the second end of the cylindrical member is an annular ring having an L-shaped cross-section and forming a flange or ledge configured to receive and seat the basket. The top surface of the ring serves to seat a portion of the valve assembly 16.

The discharge tube assembly 14 includes a generally cylindrical extension tube 45 having a first end that is received by and extends through the first collar 30 on the tank 12 and a second end that is releasably coupled to the basket 18. A fluid passage extends between a first and second port at the first and second ends of the exhaust tube. The first end of the extension tube may be attached to a flange to facilitate the attachment of the air cannon 10 to a bulk material handling structure having a chamber adapted to receive and pass bulk granular material therethrough. The bulk material handling structure may be a storage receptacle, bin, silo, transfer chute, ductwork, or other bulk material handling structure. The extension tube 45 is located generally about the central, longitudinal axis 21 extending through the discharge tube assembly 14, valve assembly 16, and basket 18. Aligning the discharge tube assembly 14 and valve assembly 16 provide for a central location for the energy discharge, resulting in increased efficiency of operation and output power in comparison with prior art air cannons. Likewise, mounting the discharge tube assembly 14 and valve assembly 16 as close to the longitudinal center line of the tank 12 further adds to the efficiency of operation and output power of the present inventive air cannon 10.

The basket 18 is comprised of a two-tiered cylindrical housing having a first portion configured to releasably mate with the second end of the extension tube 45 and a second portion configured to receive the valve assembly 16 and mate with the second collar 32 on the sidewall of the tank 12. The basket 18 is open-ended forming an internal chamber extending from the first portion to the second portion that is divided into an upper and lower chamber by the discharge piston 114, as described below. The first portion comprises a sidewall having an inner diameter that generally corresponds to the exterior diameter of the second end of the extension tube 45 to enable press-fit or friction-fit engagement of the second end of the extension tube 45 and first portion of the basket 18. The interface is sealed by first and second resilient elastomeric sealing members, such as rubber O-rings, seated in grooves disposed on the interior surface of the first portion of the basket 18. The interior surface of the first end further comprises a flange extending inwardly from and substantially perpendicular to the sidewall. The flange is configured to restrict continued insertion of the second end of the extension tube 45 into the first end of the basket 18. Abutment of the second end of the extension tube 45 against the flange therefore acts as a mechanical stop.

Above the flange is a basket sealing member 66 in the form of a ridge configured to abut a resilient elastomeric sealing member 116 disposed on the base portion of the discharge piston 114. When the discharge piston 114 is in the extended charge position, as will be described in detail below, the sealing members 66, 116 are in sealing engagement, preventing fluid communication between the interior chamber of the tank 12 and the fluid passage of the extension tube 45.

Figure 10:
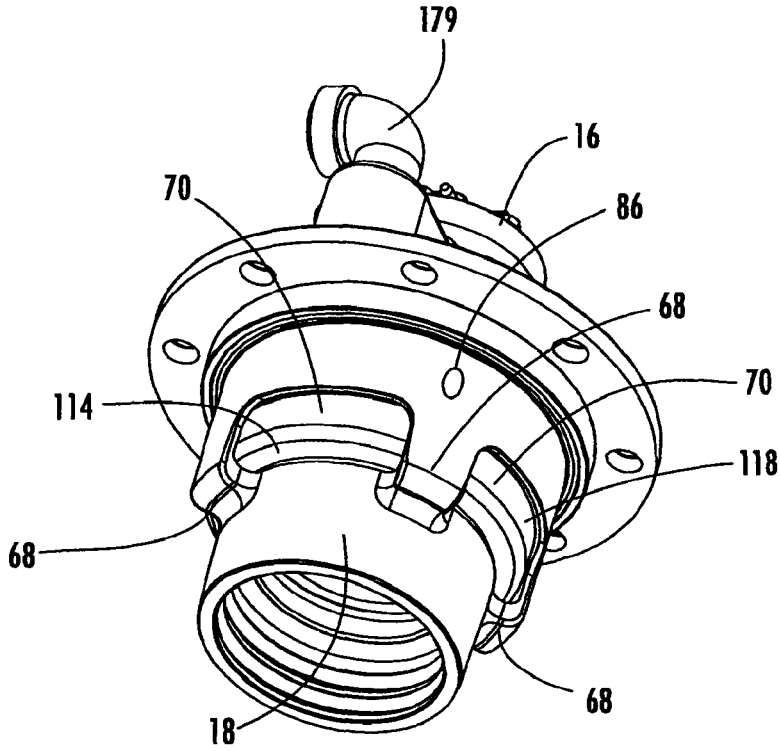
FIG. 10 is a perspective view of the basket.
Figure 11:
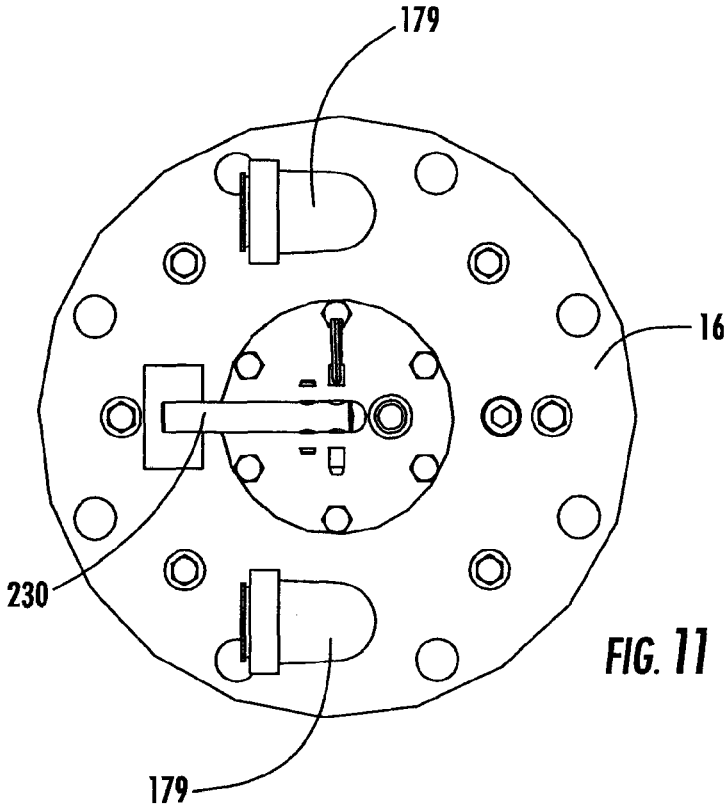
FIG. 11 is a top plan view of the basket.
Figure 12:
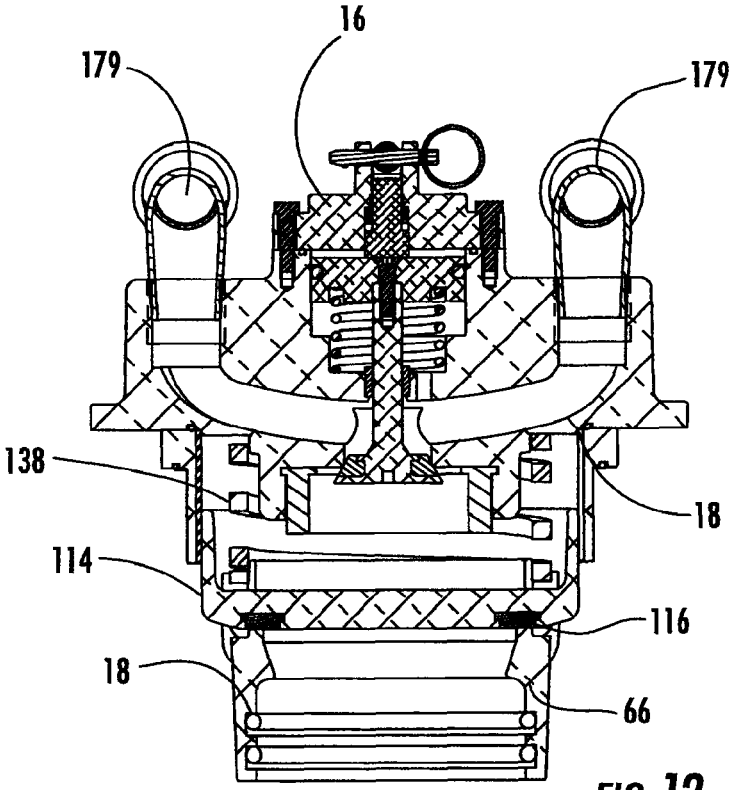
FIG. 12 is a cross-sectional view of the basket, taken along lines 12-12 of FIG. 13.
Figure 13:
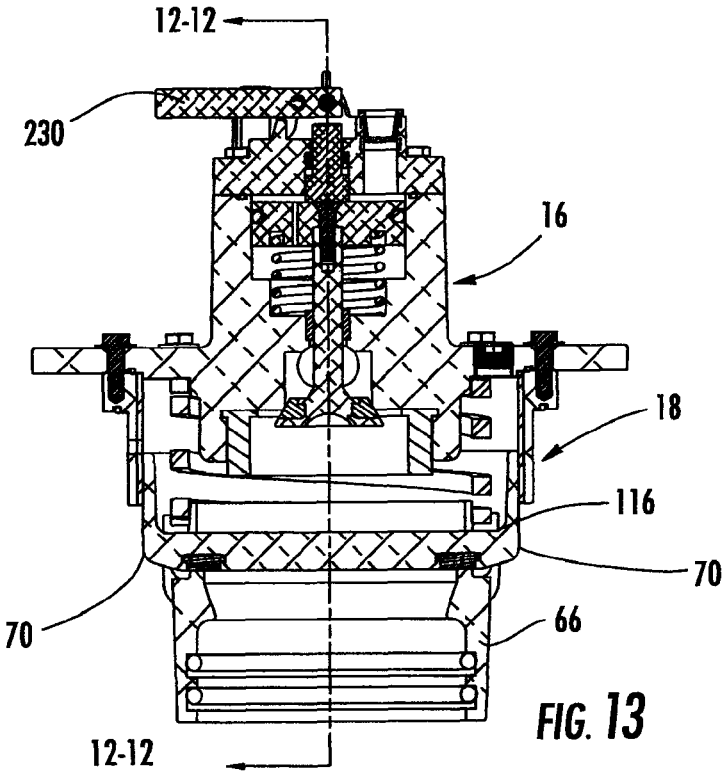
FIG. 13 is a cross-sectional view of the basket.
Figure 14:
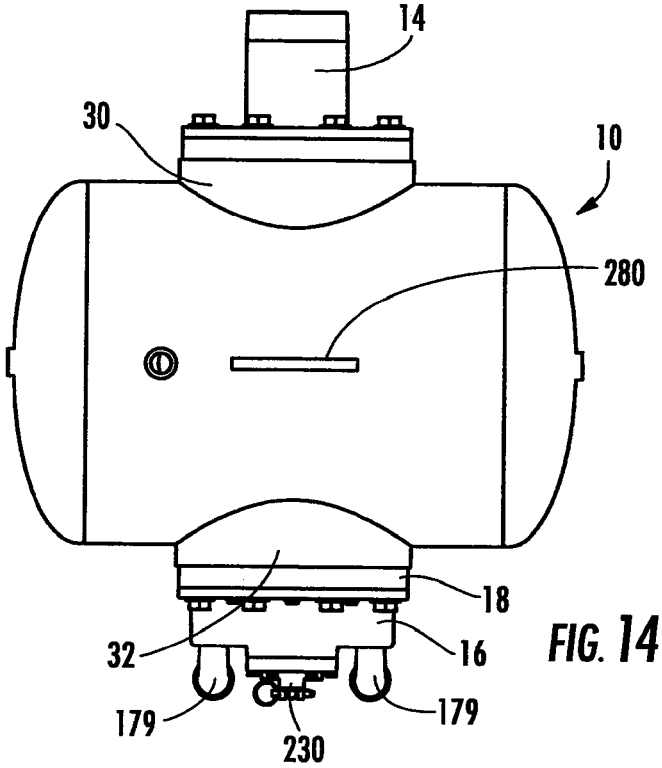
FIGS. 14 and 15 are elevational views of the air cannon of the present invention.
Figure 15:
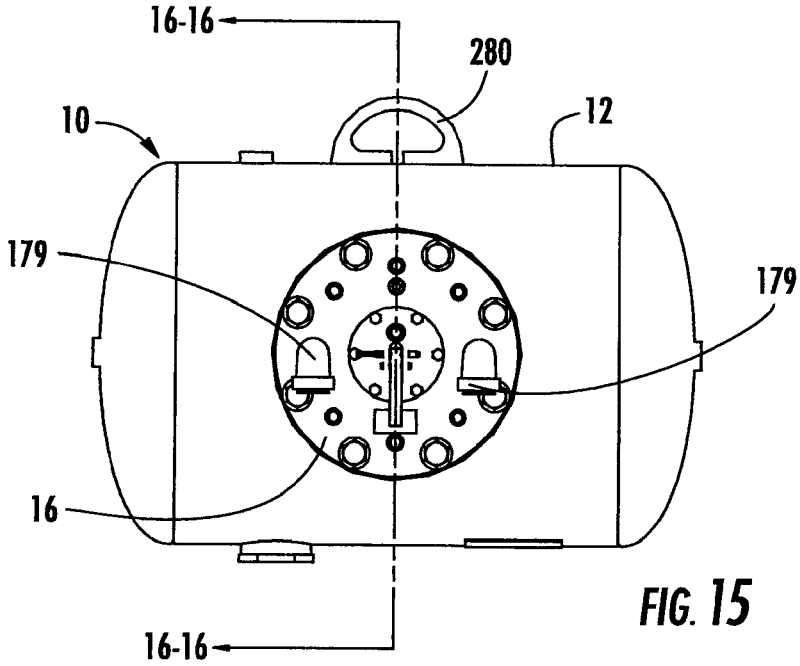
Figure 16:
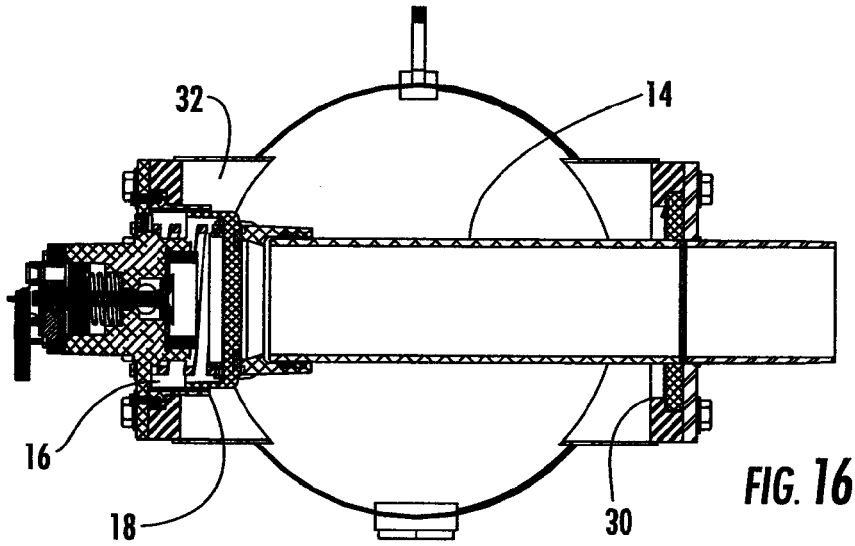
FIG. 16 is a cross-sectional view of the air cannon of the present invention, taken along lines 16-16 of FIG. 15.
Figure 17:
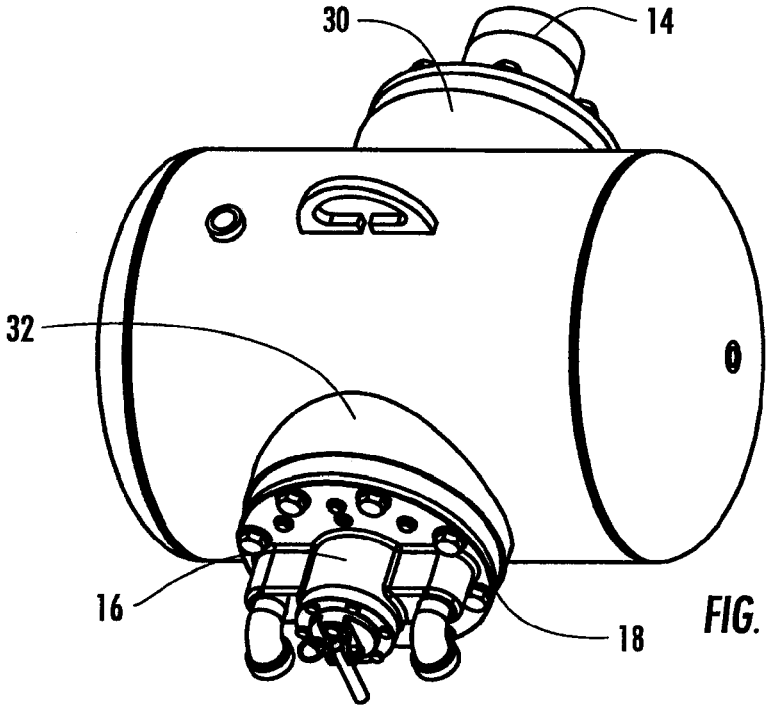
FIG. 17 is a perspective view of the air cannon of the present invention.
Figure 18:
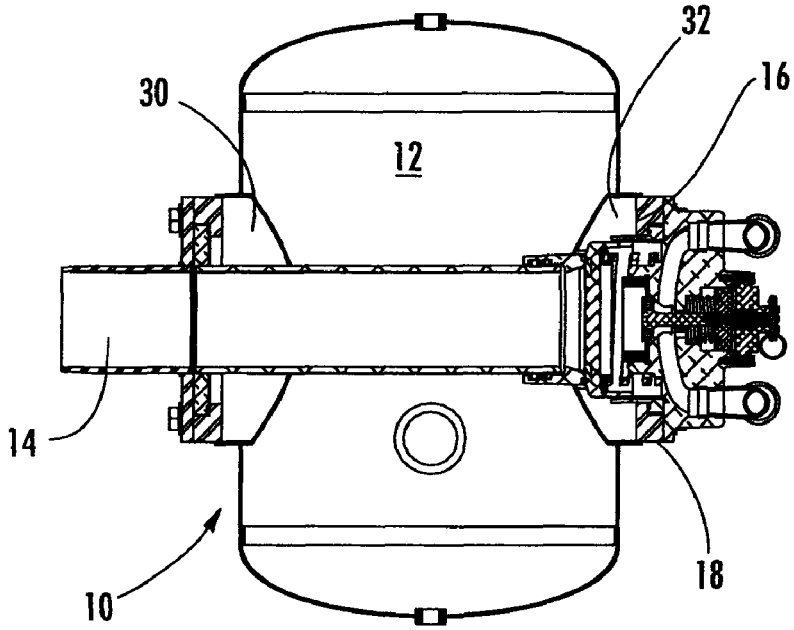
FIG. 18 is a partial cross-sectional view of the air cannon of the present invention showing, in particular, the manual actuator member in its retracted position.
Figure 19:
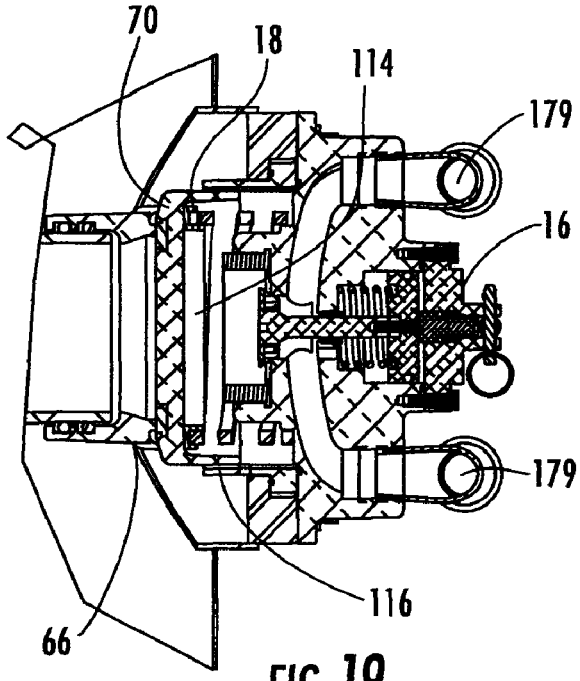
FIG. 19 is an enlarged, cross sectional view of the basket portion of FIG. 18, showing, in particular, the manual actuator member in its retracted position.
Figure 20:
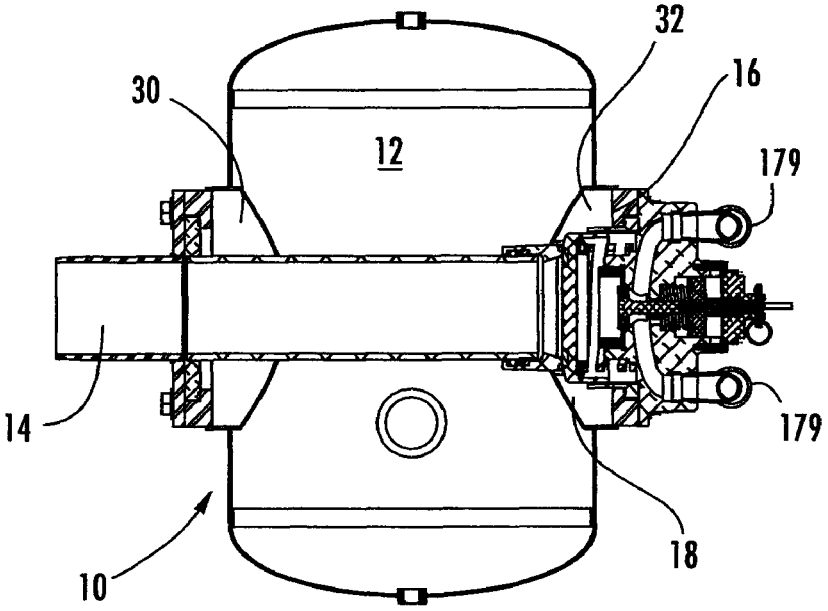
FIG. 20 is a partial cross-sectional view of the air cannon of the present invention showing, in particular, the manual actuator member in its deployed position.
Figure 21:
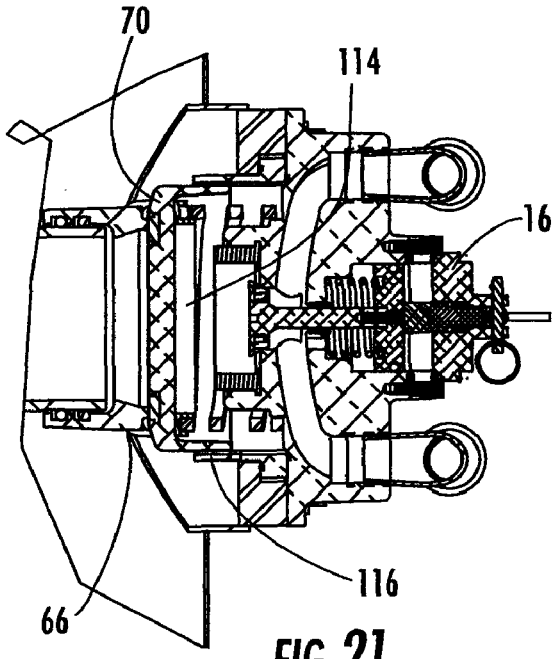
FIG. 21 is an enlarged, cross-sectional view of the basket portion of FIG. 20, showing, in particular, the manual actuator member in its deployed position.
Figure 22:
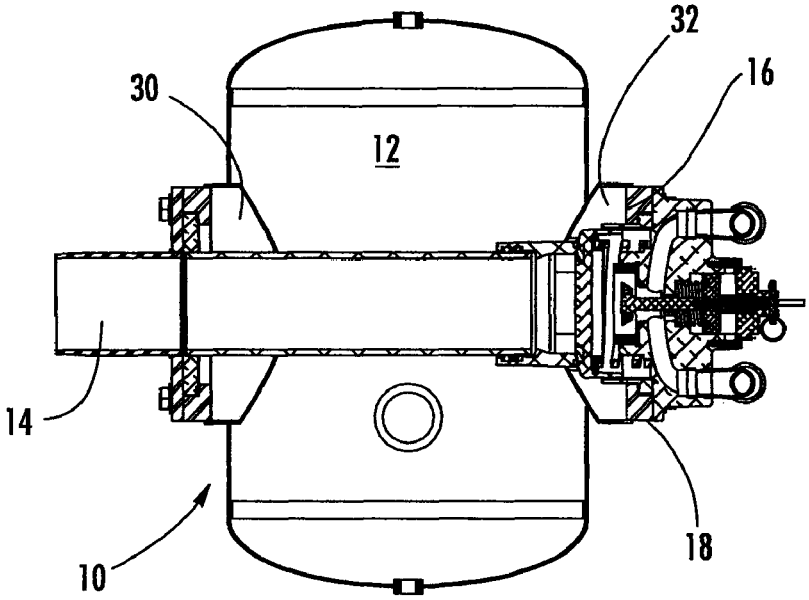
FIG. 22 is a partial cross-sectional view of the air cannon of the present invention showing, in particular, the plunger in its extended, discharge position.
Figure 23:
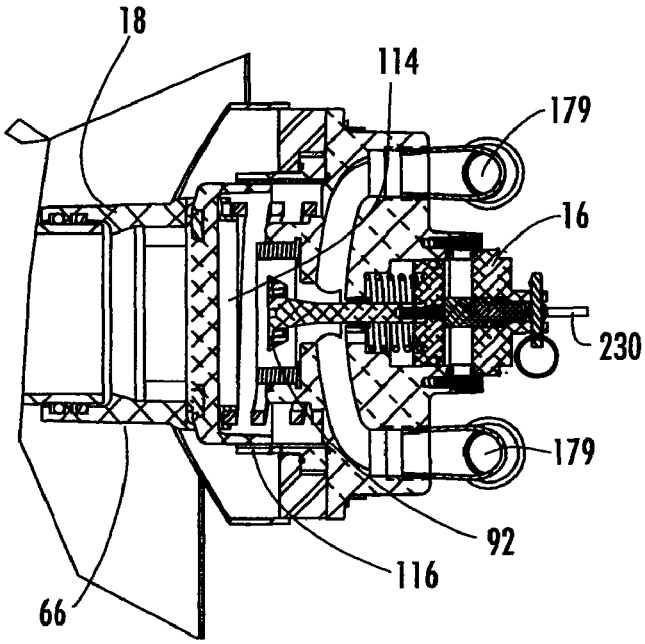
FIG. 23 is an enlarged, cross-sectional view of the basket portion of FIG. 22, showing, in particular, the plunder in its extended, discharge position.

The first and second ends of the basket 18 are interconnected by a plurality of L-shaped cross-section connecting members 68 that are integrally formed with the first and second ends of the basket 18. Referring specifically to FIG. 10, the connecting members 68 are spaced apart to form a plurality of ports 70 for facilitating fluid communication between the interior chamber of the tank 12 and the fluid passage of the extension tube 45 when the ports 70 are open. The ports 70 are opened and closed by operation of the discharge piston 114, as is described in detail below, such that when the discharge piston 114 is in its extended charge position (FIGS. 1, 3 and 6), the ports 70 are closed and when the discharge piston 114 is in its retracted discharge position (FIGS. 7 and 8), the ports 70 are opened. In the embodiment of the present inventive air cannon shown in the appended figures, a first, second, third and fourth connecting member are utilized, forming a first, second, third and fourth port in the basket 18. In other preferred embodiments of the present invention, any number of connecting members and ports may be utilized.

The size and proximity of the ports 70 to the interior chamber of the tank 12 facilitate rapid and substantially unobstructed and uninhibited fluid communication between the interior chamber of the tank 12 and the fluid chamber of the extension tube 45 when the ports 70 are opened. As is seen in FIG. 10, the surface area of each port 70 is significantly greater than the surface area of adjacent connector members 68. This feature, in combination with the central location of energy discharge resulting from the placement of the valve assembly 16 and discharge tube assembly on the tank 12 described above, facilitates a smooth release of pressurized gas at discharge, and, in turn, increased force output of the air cannon 10.

Figure 9:
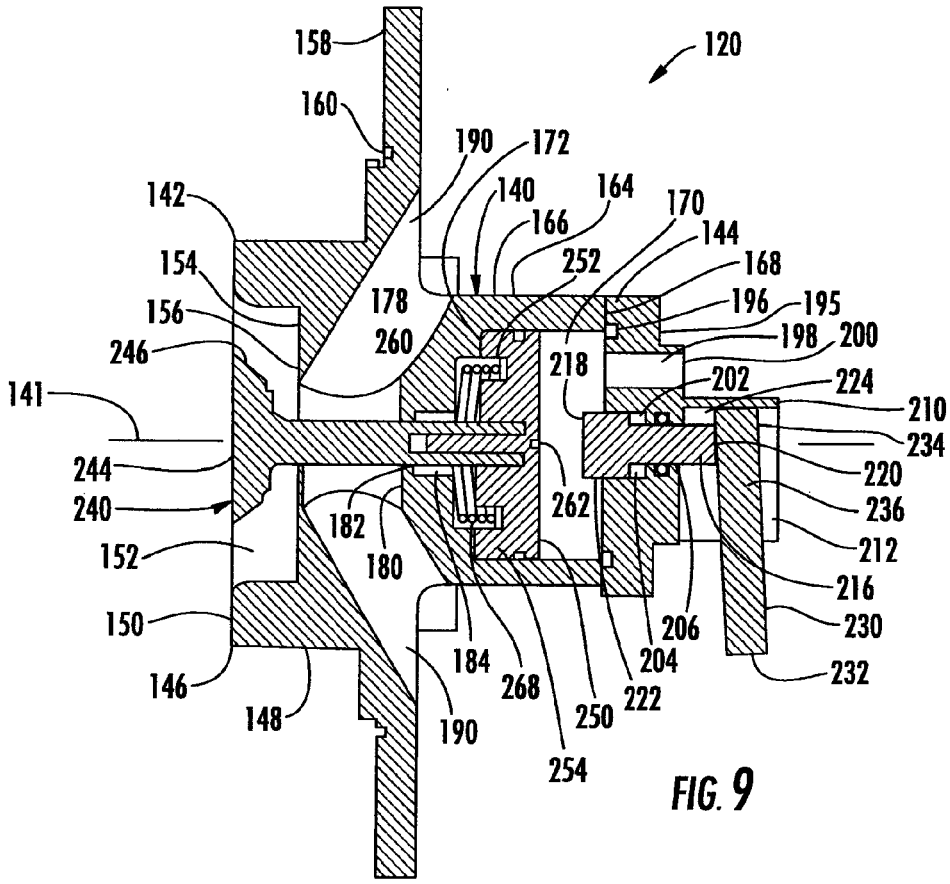
FIG. 9 is a partial cross-sectional view of the positive pressure valve assembly of the air cannon of the present invention.
Figure 9A:
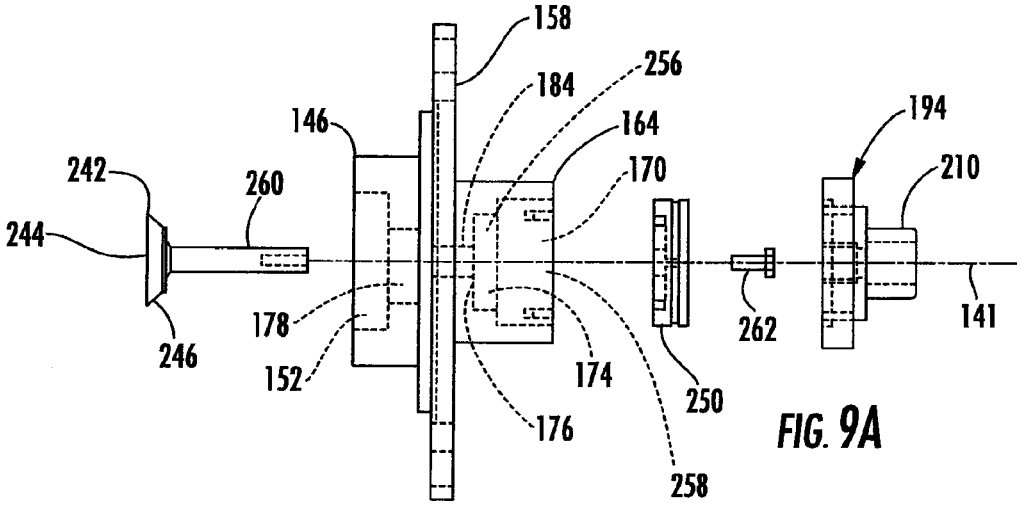
FIG. 9A is an exploded view of components of the positive pressure valve assembly of the air cannon of the present invention.

The cylindrical sidewall of the second end of the basket 18 terminates into an outwardly extending lip. The underside of the lip abuts the Ledge of the annular ring of the collar 32. The top surface of the lip abuts the flange portion 158 (FIG. 9) of the body of the positive pressure valve 120 (FIG. 9). A concentrically aligned through hole in the lip and threaded bore in the flange 158 of the body receive a threaded fastener to secure the valve assembly 16 to the basket 18.

The second end of the basket 18 further comprises a fill hole, or control port 86 (FIGS. 3 and 4) disposed on the sidewall that enables fluid communication between the interior chamber of the tank 12 and a fluid chamber 92 within the valve assembly 16 defined by the base and skirt 118 of the discharge piston 114 and the body of the positive pressure valve 120. In the present embodiment, the sidewall comprises a low friction sliding surface for slideable engaging the skirt 118 of the discharge piston 114.

Figure 7:
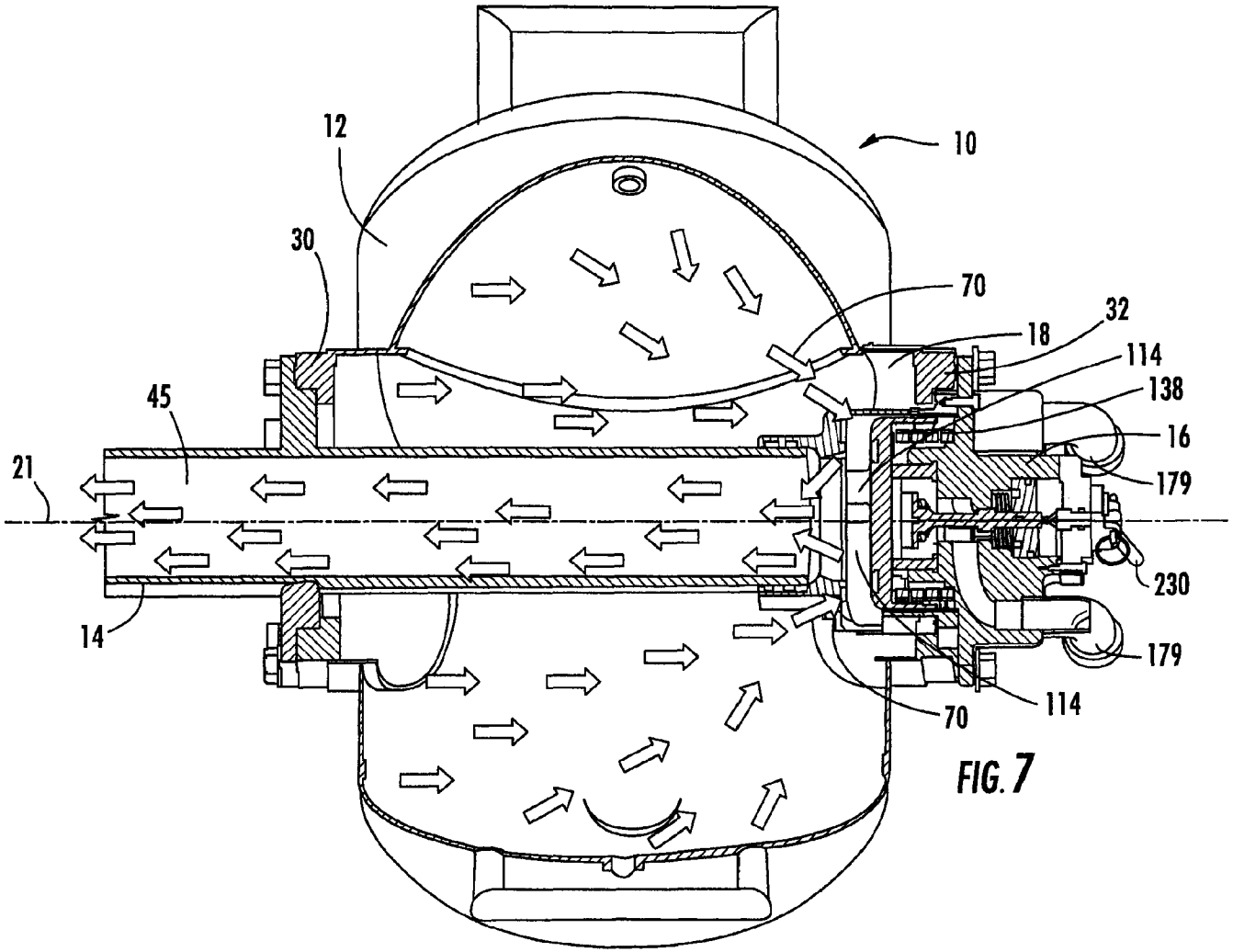
FIG. 7 is a partial cross-sectional view of the air cannon of the present invention, showing, in particular, a second phase of the firing operation.
Figure 8:
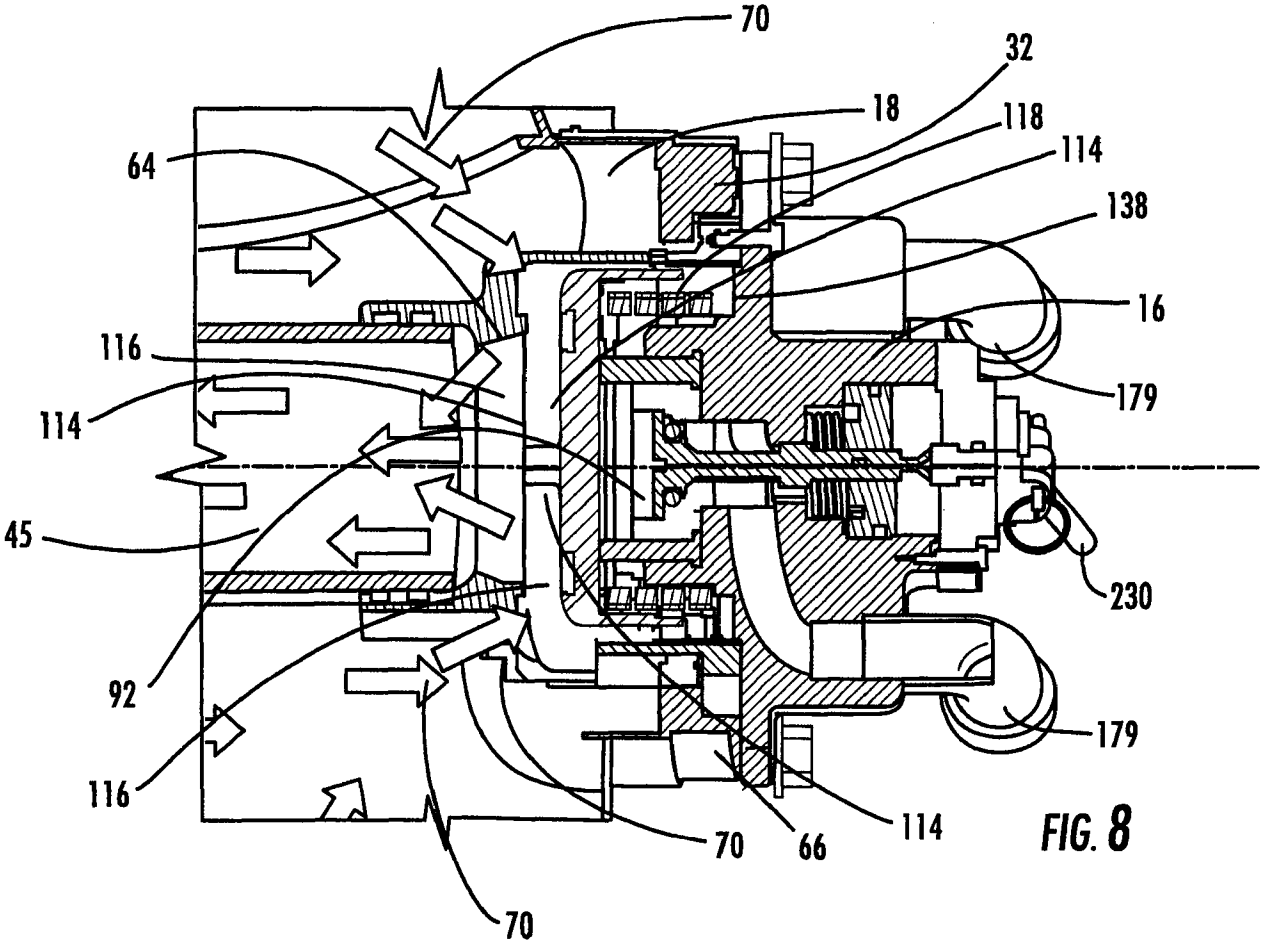
FIG. 8 is an enlarged, cross-sectional view of the basket, showing, in particular, a second phase of the firing operation.

The discharge piston 114 is longitudinally slideable along the longitudinal axis 21 between an extended charge position as shown in FIGS. 1, 3-6, wherein the discharge piston sealing member 116 and the basket sealing member 66 are in sealed engagement, and a retracted discharge position as shown in FIGS. 7 and 8, wherein the discharge piston 114 is spaced apart from the basket sealing member 66. The skirt 118 of the discharge piston 114 slideably engages the interior surface of the sidewall of the second portion of the basket 18 and guides the discharge piston 114 as it moves between the extended and retracted positions. As the discharge piston transitions between the extended charge position and the retracted position, the skirt 118 slides to close or open port 86. and, in turn, to close or open ports 70 of basket 18, respectively.

The valve assembly 16 also includes a resilient biasing member 138, such as a helical coil spring. The biasing member 138 extends between the discharge piston 114 and the body 195 of the positive pressure actuated valve 12, and extends around the sidewall 148 of the hub 146 of the body (FIG. 9). The first end of the biasing member 138 seats in an annular track disposed around the interior side of the skirt 118 and engages the interior surface of the base 117 of the discharge piston 114. The biasing member 138 resiliently biases the discharge piston 114 toward the piston seat 64 and toward the extended charge position of the discharge piston 114.

As shown in FIGS. 1-9 and shown in detail in FIG. 9, the positive pressure actuated valve 120 includes a body having a central longitudinal axis 141 that is coaxial with the longitudinal axis 21 (FIG. 1). The body extends between a first end 142 and a second end 144. The body includes a generally cylindrical hub 146 at the first end 142. The hub 146 includes a generally cylindrical sidewall 148 and an annular planar end wall 150. The hub 146 includes a hollow generally cylindrical recess 152 that is located concentrically within the hub 146 and that extends inwardly from the end wall 150. The recess 152 forms a bottom wall 154 that includes a central generally circular aperture that forms a generally circular actuator piston seat 156. A flange 158 extends radially outwardly from and around the hub 146 generally perpendicular to the central longitudinal axis 141. The flange 158 includes bores that is coaxially align with a corresponding threaded channels in the ring 40 of the second collar 32 (FIG. 1) for receiving a threaded fastener.

A resilient elastomeric sealing member 160, such as an O-ring, is located on the interior surface of the flange 158 and extends around the hub 146. The flange 158 of the body also includes a stem 164 that extends from the hub 146 to the second end 144 of the body. The stem 164 includes a generally cylindrical sidewall 166 and a generally annular and circular planar end wall 168. The stem 164 includes a generally cylindrical first recess 170 that extends inwardly from the end wall 168 toward the first end 142 of the body. The first recess 170 forms a generally planar and annular inwardly extending ledge 172. The stem 164 includes a second recess 174 that extends from the ledge 172 to a bottom wall 176 having a circular central aperture. The first and second recesses 170 and 174 are concentrically located about the longitudinal axis 141.

The body of the valve 120 includes a generally cylindrical bore 178 that extends from the actuator piston seat 156 to a generally annular wall 180 having a generally circular central aperture 182. The body also includes a generally cylindrical bore 184 that extends from the central aperture in the bottom wall 176 to a generally annular end wall that includes the aperture 182. The recess 152, bore 178, bore 184, second recess 174 and first recess 170 are all connected to one another. The body includes one or more fluid vent passages 190. Each vent passage 190 includes a first end in fluid communication with the bore 178 and the actuator piston seat 156, and a second end that is in fluid communication with the atmosphere via exhaust pipes 179 (FIG. 1). A fluid passageway extends from the second recess 174 to a vent passage 190 such that the second recess 174 is in fluid communication with the atmosphere.

The positive pressure actuated valve 120 also includes a cap 194 that is removably attached to the end wall 168 of the stem 164 by threaded fasteners or the like. The cap 194 includes a body 195. A resilient elastomeric sealing member 196, such as an O-ring, is located between the body 195 and the end wall 168 and is adapted to create a gas-tight seal there between. The body 195 includes a fluid passage 198 that extends through the body 195 and that is in fluid communication with the first recess 170 of the stem 164. The fluid passage 198 includes a port 200 that is adapted to be attached in fluid communication with a source of pressurized gas, such as air. The port 200 may be attached in fluid communication with a valve, such as a solenoid valve, to control the flow of gas into and out of the port 200 and fluid passageway 198. The body 195 includes a stepped-bore 202 that extends through the body 195 from its internal surface to its external surface. The bore 202 includes a large diameter recess 204 that extends inwardly from the interior surface of the body 195 and a reduced diameter recess 206 that extends inwardly from the outer surface of the body 195. The body 195 also includes a generally U-shaped collar 210 that is attached to the external surface of the body 195. The collar 210 includes spaced apart opposing sidewalls 212.

The cap 194 includes a plunger 216 slideably located within the bore 202. The plunger 216 includes a first end 218 and a second end 220. The plunger 216 includes a generally cylindrical head 222 at the first end 218 that is adapted to fit closely within the large diameter recess 204 of the bore 202. The plunger 216 also includes a generally cylindrical shaft 224 that extends from the second end 220 to the head 222. The shaft 224 extends through the reduced diameter recess 206 of the bore 202 such that the second end 220 of the plunger 216 is located within the collar 210 between the sidewalls 212. A resilient elastomeric sealing member, such as an O-ring, is located between the shaft 224 of the plunger 216 and the side wall of the reduced diameter recess 206 of the bore 202 to create a gas-tight seal there between, while allowing the plunger 216 to slideably move between a retracted position and an extended position along the axis 141. The cap 194 also includes a manual actuator member 230, such as a lever, trigger or button. The actuator member 230 extends between a first end 232 and a second end 234. The actuator member 230 is pivotally attached to the sidewalls 212 of the collar 210 such that the first and second ends 232 and 234 pivot about a pivot axis 236 with respect to the body 195 of the cap 194.

The positive pressure actuated valve 120 also includes an actuator piston 240. The actuator piston 240 includes a head 242. The head 242 includes a generally circular and planar outer end wall 244 and a generally conical-shaped sidewall 246. A first end of the conical side wall 246 includes a large diameter circular edge located at the end wall 244 and a second end of the side wall 246 includes a reduced diameter circular edge. The sidewall 246 of the actuator piston 240 is adapted to releasably engage the piston seat 156 to selectively create a gas-tight seal therewith. The actuator piston 240 also includes a generally cylindrical diaphragm 250 located within the first recess 170 of the stem 164. The outer peripheral edge of the diaphragm 250 includes a resilient elastomeric sealing member 252, such as an O-ring. The sealing member 252 creates a gas-tight seal between the diaphragm 250 and the internal wall of the stem 164 while allowing sliding movement of the diaphragm 250 within the first recess 170 between a retracted position and an extended position.

The interior side of the diaphragm 250 includes an elongate generally circular groove 254. The actuator piston 240 also includes a generally cylindrical stem 260 that is attached at a first end to the internal surface of the head 242 and that is removably attached at a second end to the diaphragm 250 by a fastener 262. The diaphragm 250 and the head 242 thereby slide conjointly with one another between a retracted position and an extended position along the axis 141. The diaphragm 250 divides the recesses within the stem 164 into a first chamber 256 that is located between the diaphragm 250 and the bottom wall 176 of the second recess 174, and a second chamber 258 that is located between the diaphragm 250 and the cap 194.

Figure 3:
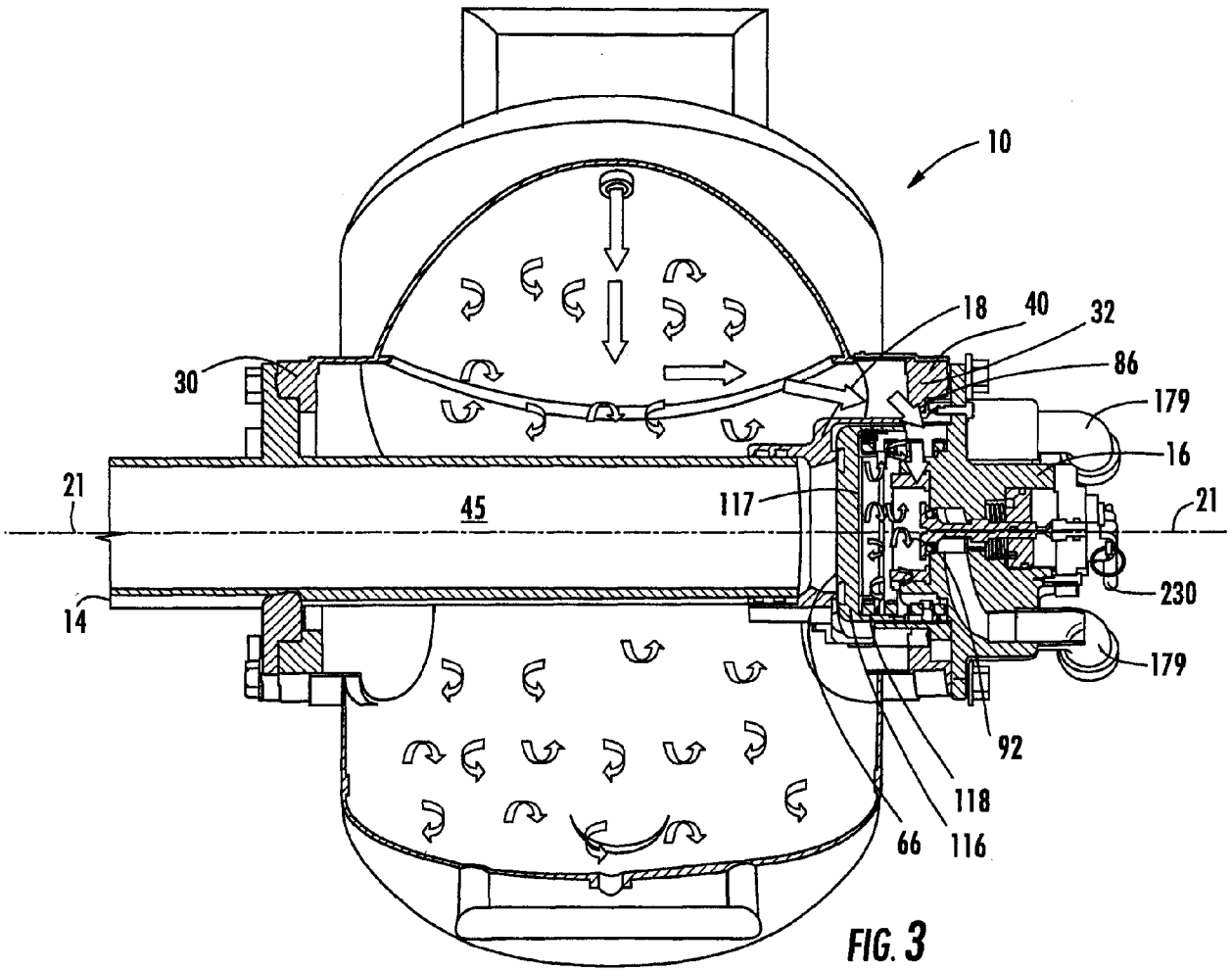
FIG. 3 is a partial cross-sectional view of the air cannon of the present invention, showing, in particular, the filling operation.
Figure 4:
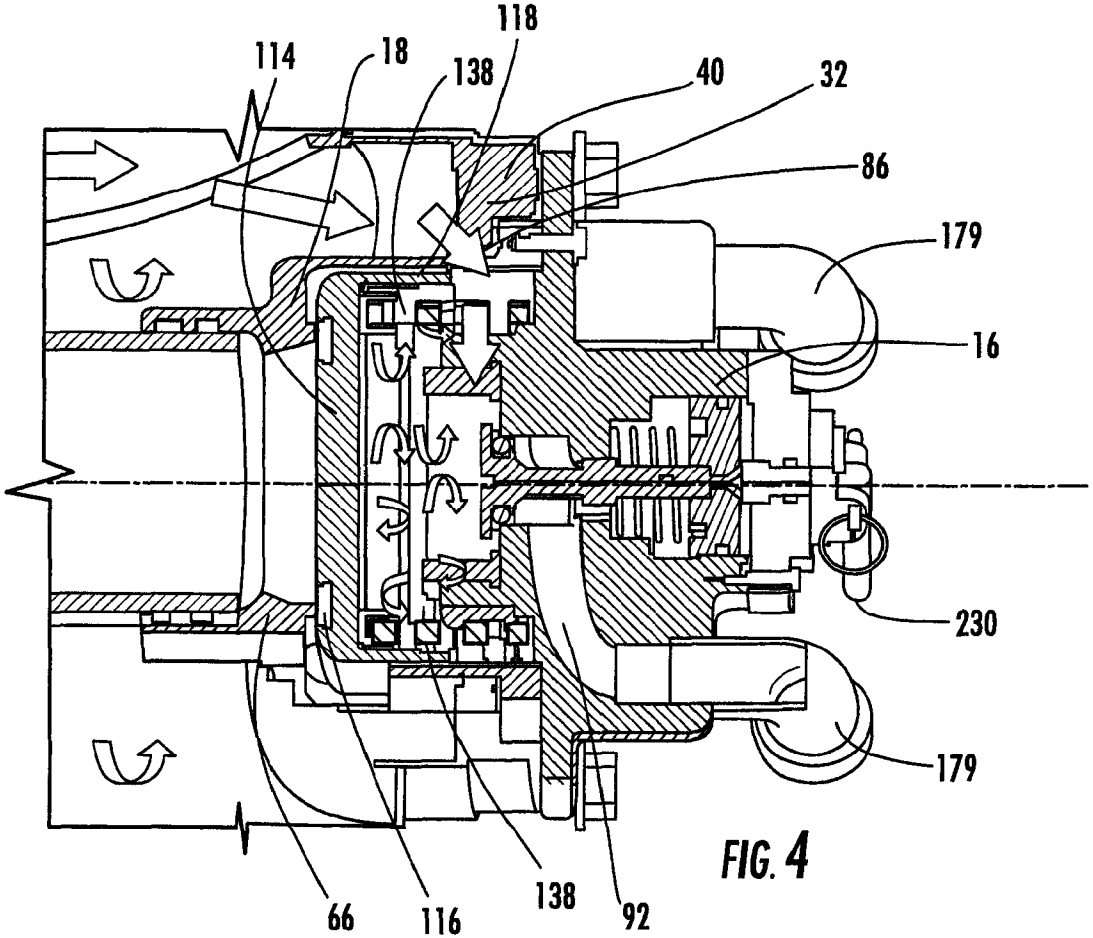
FIG. 4 is an enlarged, cross-sectional view of the basket, showing, in particular, the filling operation.
Figure 5:
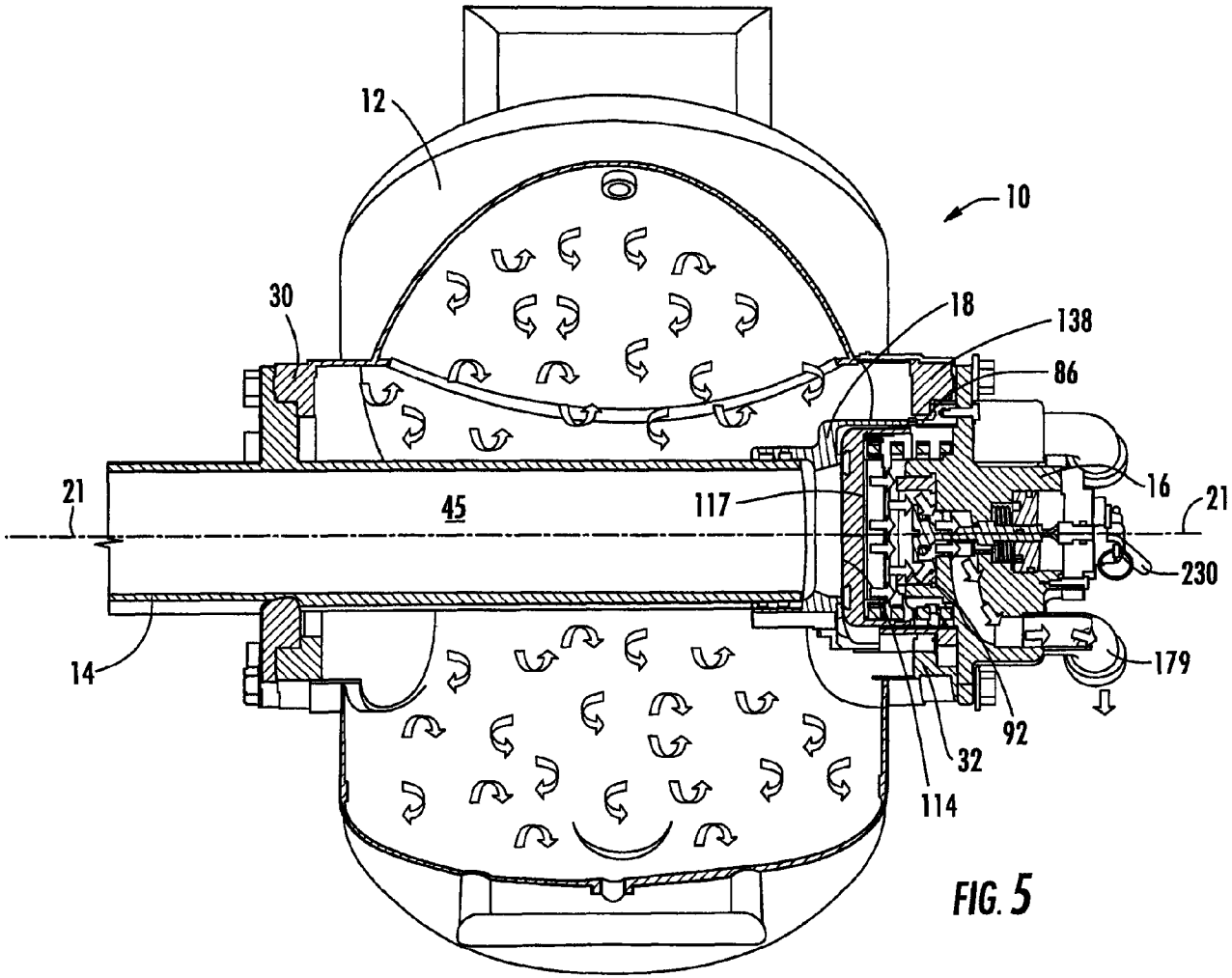
FIG. 5 is a partial cross-sectional view of the air cannon of the present invention and showing, in particular, a first phase of the firing operation.
Figure 6:
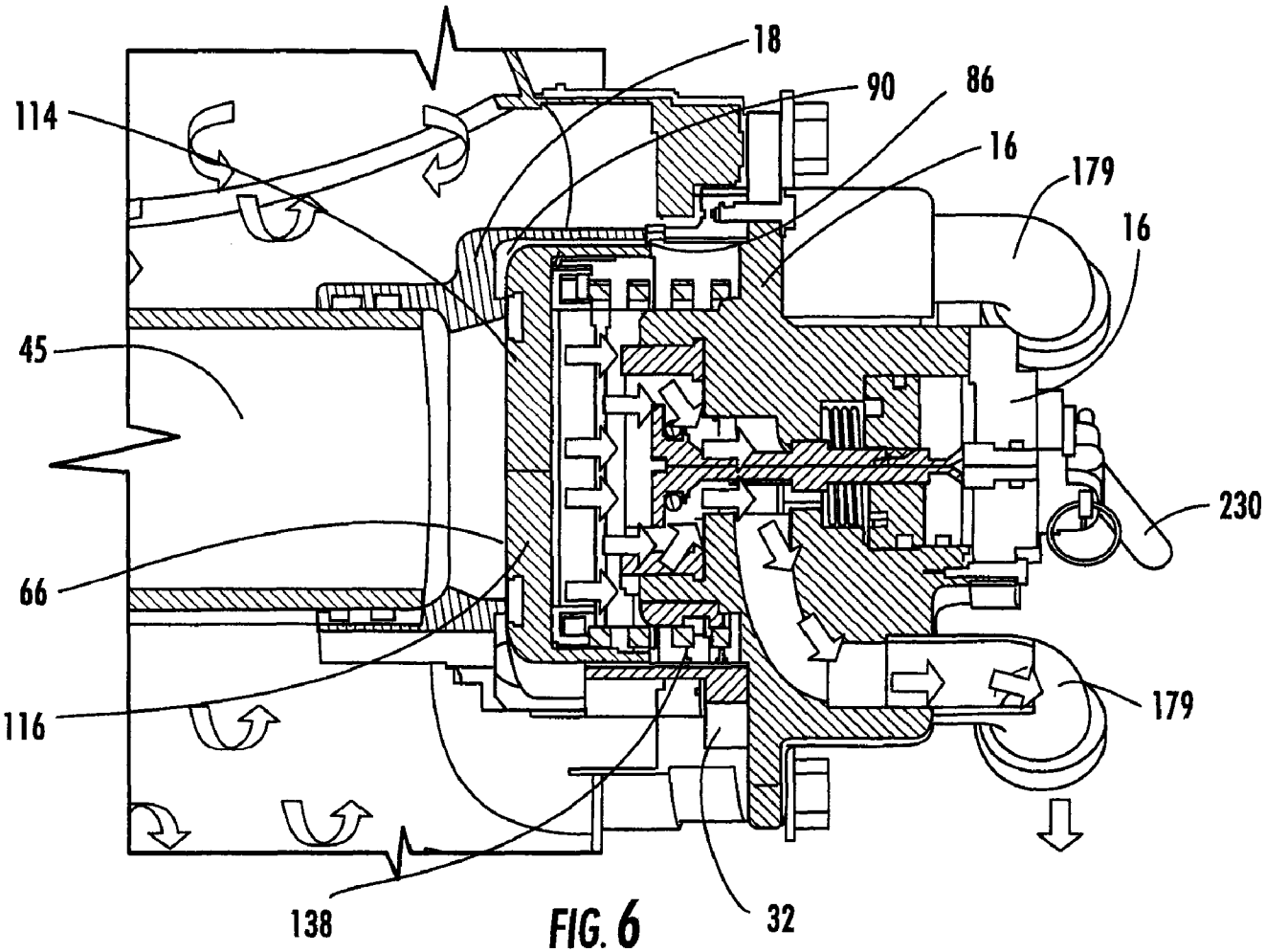
FIG. 6 is an enlarged, cross-sectional view of the basket, showing, in particular, a first phase of the firing operation.

The positive pressure actuated valve 120 also includes a resilient biasing member 268, such as a helical coil spring. The biasing member 268 has a first end in engagement with the bottom wall 176 of the second recess 174 of the stem 164, and a second end located within the circular groove 254 of the diaphragm 250. The biasing member 268 resiliently biases the actuator piston 240 towards the charge position as shown in FIGS. 1, 3-4.

As has been described herein and shown in the appended figures, the incorporation of the receiving member or basket 18 provides for ease of assembly and disassembly of air cannon 10 of the present invention. This ease of assembly and disassembly results in ease of serviceability of air cannon 10, inasmuch as tank 12 does not have to be removed from its mount in order to perform maintenance on the critical parts of the air cannon 10. Insertion of the valve assembly 16 within the basket aligns the fluid chambers of the valve assembly with the fluid ports of the basket 18. Accordingly, coupling of the basket 18 and discharge tube assembly 14 aligns the fluid chambers of the valve assembly 16 with the interior chamber of the tank 12 and the fluid chamber of extension tube 45 of the discharge tube assembly 14.

In addition, the manner in which the pressurized gas is introduced into the basket 18 and discharge tube assembly 14 greatly increases the efficiency of the air cannon 10 by resulting in a smoother release of the pressurized gas at discharge and at a substantially increased force output over prior art air cannons, and specifically an increase in force output by more than 70% over prior art cannons. In contrast to prior art air cannons in which pressurized gas from a storage tank is constricted into a feed tube and then introduced to the valve assembly via relatively small diameter bores or channels, the incorporation of large ports 70 in the basket 18 that are adjacent to both the interior chamber of the tank 12 and the valve assembly 16 and discharge tube assembly 14. When the ports 70 are open, there is substantially unobstructed fluid communication between the interior chamber of the tank 12 and the discharge tube assembly 14 resulting in the increased operating efficiency and increased output force over prior art air cannons.

FIGS. 3-8 and 20-25 show the air cannon 10 of the present invention in operation. Initially, the discharge piston 114 is located in its extended charge position and the actuator piston 240 is located in its retracted charge position. When the discharge piston 114 is in its extended charge position, the basket sealing member 66 sealingly engages the sealing member 116 of the discharge piston 114 to create a gas-tight seal there between. The fluid passage from the interior chamber of the tank 12 through the ports 70 and into the fluid passage of the extension tube 45 is thus sealed closed by the discharge piston 114.

When the discharge piston 114 is in its extended charge position, the port 86 on the sidewall of the second portion of the basket 18 is opened enabling fluid passage of pressurized gas from the interior chamber of the tank 12 into the fluid chamber 92 behind the discharge piston 114. When the actuator piston 240 is in its retracted charge position, the conical side wall and sealing member of the actuator piston 240 create a gas-tight seal with the actuator piston seat to seal closed a fluid passage from the fluid chamber 92 through the actuator piston seat to the vent passages 190. The pressurized gas within the fluid chamber 92 biases the discharge piston 114 to its extended charge position and acts upon the end wall 244 of the head 242 of the actuator piston 240 to bias the actuator piston 240 toward its retracted charge position. The first chamber 256 of the positive pressure actuated valve 120 is in fluid communication with the vent passages 190 through the aperture 182 and bore 184 and is therefore at atmospheric pressure.

In the embodiment of the present invention shown in FIGS. 3-8, release of the pressurized gas in the interior chamber of the tank 12 into the storage bin holding the bulk material may be actuated manually. The first end 232 of the manual actuator member 230 is manually grasped and pivoted in a counter-clockwise direction about the pivot axis 236. The second end 234 of the manual actuator member 230 is thereby also pivoted about the pivot axis 236 into engagement with the second end 220 of the plunger 216. Continued counter-clockwise pivotal movement of the manual actuator member 230 causes the plunger 218 to slide along the axis 141 from its retracted position, as shown in FIG. 3, to its extended position shown in FIGS. 5 and 7. As the plunger 218 moves from the retracted position toward the extended position, the head 222 of the plunger 216 engages the diaphragm 250 of the actuator piston 240 and slides the actuator piston 240 along the axis 141 from its retracted position towards its extended discharge position.

When the actuator piston 240 is in the extended discharge position (FIGS. 5-8), the seal between the head 242 and the actuator piston seat 156 is broken such that a fluid passage extends from the fluid chamber 92, through the recess 152 of the hub 146, through the actuator piston seat 156 to the bore 178, and through the vent passages 190 to the atmosphere. The pressure of the gas within the fluid chamber 92 is thereby reduced to atmospheric pressure. Even though port 86 couples the interior chamber of the tank 12 to the fluid chamber 92, port 86 is relatively smaller than the passage between fluid chamber 92 and vent passages 190. A pressure differential is consequently created between the pressure of the gas in the fluid chamber 92 that is at atmospheric pressure, and the pressure of the gas within the interior chamber of the tank 12 that is pressurized at a pressure greater than atmospheric pressure. The gas force acting on the discharge piston 114 through ports 70 is larger than the cumulative force exerted on the discharge piston 114 by the gas at atmospheric pressure in the fluid chamber 92 and the biasing force exerted by the biasing member 138. This differential in gas pressure and the resulting difference in the forces acting on the discharge piston 114, cause the discharge piston 114 to slide from the extended charge position as shown in FIG. 3, toward the positive pressure valve 120 and toward the retracted discharge position of FIGS. 5 and 7, while compressing the biasing member 138.

The movement of the discharge piston 114 from the extended charge position to the retracted discharge position breaks the seal created between the sealing members 66, 116 and opens the fluid passage from the interior chamber of the tank 12, through the ports 70 and into the fluid passage of the extension tube 45. The pressurized gas flows from the fluid passage of the extension tube 45 out the port at the first end of the extension tube 45 and into the chamber of the storage bin to dislodge the material therein.

After the pressurized gas from the tank 12 has been discharged, the manual actuator member 230 may be released. The biasing member 266 then slides the actuator piston 240 and the plunger 216 from their extended discharge positions to their retracted charge positions. As the plunger 216 slides back to its retracted position, the plunger 216 pivots the manual actuator member 230 from its discharge position to its charge position. The tank 12 is resupplied with pressurized gas, a volume of which will flow through the port 86 in the sidewall of the basket 18 and into the fluid chamber 92 behind the discharge piston 114. The pressure of the gas within the fluid chamber 92 thereby equalizes with the pressure of the pressurized gas within the tank 12, and the biasing member 138 biases the discharge piston 114 to the extended charge position thereby creating a seal between the sealing members 66, 116. The charging and discharging cycles of the air cannon 10 may then be selectively continued.

In an alternative embodiment, the air cannon 10 of the present invention, pressurized air having a positive pressure greater than atmospheric pressure is supplied to the second chamber 258 of the positive pressure actuated valve 120 through the fluid passage 198. The surface area of the diaphragm 250 that is in communication with the second chamber 258 is larger than the surface area of the end wall 244 of the head 242 of the actuator piston 240. Therefore, if the gas within the second chamber 258 is at the same pressure as the gas within the fluid chamber 274, the pressurized gas within the second chamber 258 may provide a sufficient resulting biasing force to bias the actuator piston 240 toward the extended discharge position, while overcoming the force of the gas in the fluid chamber 90 and biasing force of the biasing member 268, to compress the biasing member 268 and slide the actuator piston 240 from the retracted position toward the extended position. The pressurized gas within the fluid chamber 92 is then exhausted to the atmosphere through the vent passages 190 as described above. The discharge piston 114 then moves toward its retracted position as described above to discharge gas from the tank 12 through the ports 70 and extension tube assembly 96.

Once the pressurized gas from the tank 1.2 has been discharged, the supply of pressurized gas to the second chamber 258 of the positive pressure actuated valve 120 is turned off and the second chamber 258 is placed in fluid communication with the atmosphere through the fluid passageway 198. The gas within the second chamber 258 consequently returns to atmospheric pressure. The gas in the first chamber 256 and the second chamber 258 are therefore both at atmospheric pressure. The biasing member 268 then biases the actuator piston 240 to the retracted position wherein the head 242 creates a seal with the actuator piston seat 156. The charging and discharging cycles of the air cannon 10 may be continued selectively as desired.

Figure 26:
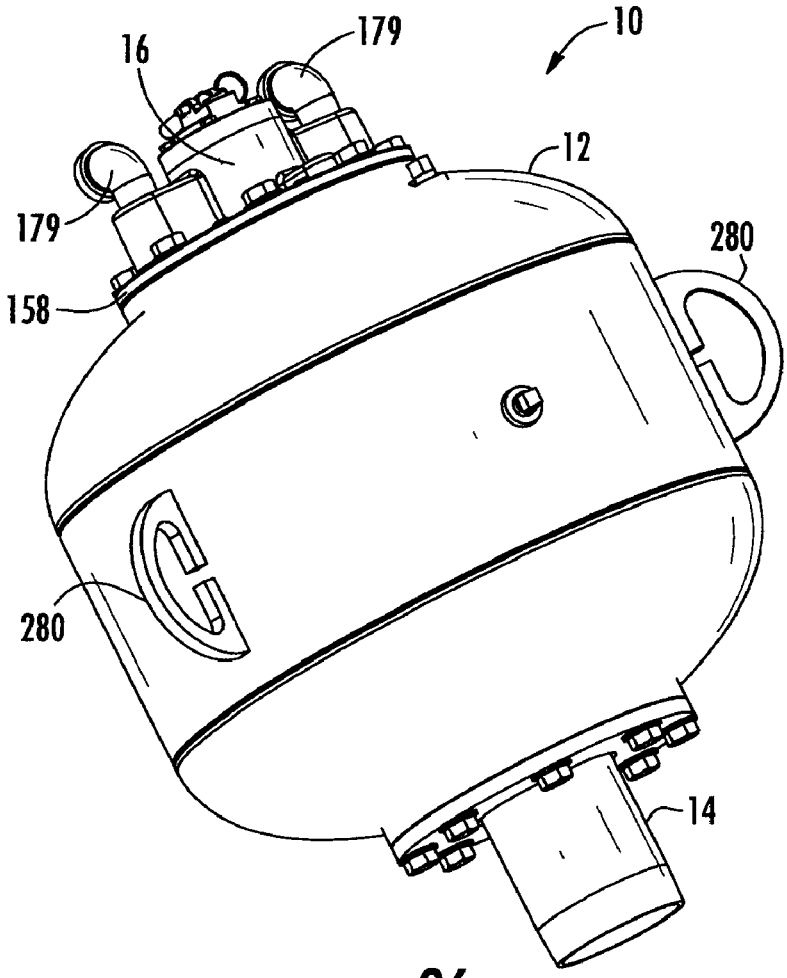
FIG. 26 is a perspective view of another embodiment of an air cannon of the present invention, showing, in particular, the flanges disposed on the head regions of the air tank, rather than the cylindrical sidewall portion of the air tank.

An alternative embodiment of the air cannon of the present invention is shown in FIG. 26. In this embodiment, the flanges associated with the basket and discharge tube are disposed proximate opposing head portions of the air tank, rather than the cylindrical sidewall region of the air tank. This embodiment of FIG. 26 is considered to be easier and, in turn, lest costly to manufacture than the previously-described embodiments.

Figure 27:
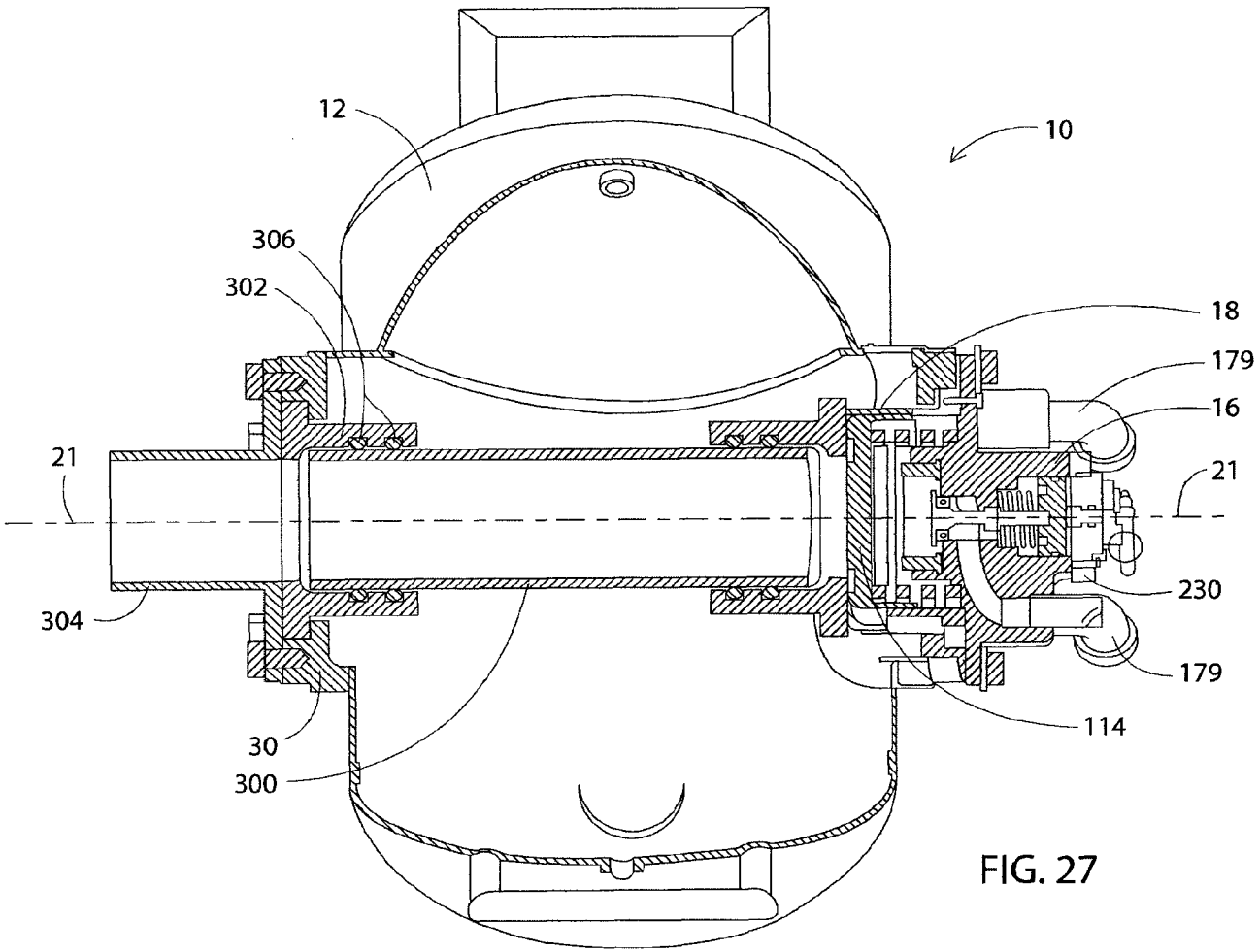
FIG. 27 is a partial cross-sectional view similar to FIG. 1 showing yet another embodiment of an air cannon of the present invention.

Yet another alternative embodiment of an air cannon is shown in FIG. 27. As shown, this embodiment shares many of same components as the embodiment shown in FIG. 1. Like the embodiment shown in FIG. 1, as can be seen in FIG. 27, this alternative embodiment comprises the same sleeve and socket type slip fitting connecting the tube and the basket, but also comprises another such fitting connecting the tube to the flange on the opposite side of the tank. As one skilled in the art can appreciate, this allows the tube to be pulled out of the tank from either of the opposite openings of the tank without requiring the removal of the other components that are attached to other of the openings. As shown in FIG. 27, this embodiment comprises an extension tube 300 that is slideably received in the basket 18 and in a receiving flange 302. The receiving flange 302 is sandwiched between the first collar 30 and a discharge tube flange 304 and comprises a pair of o-rings 306 that are held in annular grooves. The discharge tube flange 304 is preferably bolted to the tank 12 and couples the tank 12 to a bulk material handling structure. Given that the extension tube 300 of this embodiment is slideably received in both the basket 18 and the receiving flange 302 and that o-rings 306 seal the extension tube in a manner such that the extension tube does not directly engage the basket or the receiving flange, the basket and receiving flange need not be precisely aligned with each other since the extension tube can be slightly cocked relative to each. This reduces to precision required to manufacture the air cannon 10 and ensures that the o rings of the basket 18 and of the receiving flange 302 are relatively uniformly compressed. The extension tube 300 is removable from the tank 12 through the ring 40 of the second collar 32 when the valve assembly 16 and the basket are removed therefrom. With the extension tube 300, the valve assembly 16, and the basket 18 removed from the tank 12, the receiving flange 302 can be accessed through the ring 40 of the second collar 32 such that the o-rings of the receiving flange can be replaced if needed, without detaching the tank from the discharge tube flange 304.

While the present invention is described above in connection with preferred or illustrative embodiments, these embodiments are not intended to be exhaustive or limiting of the invention. Rather, the invention is intended to cover all alternatives, modifications and equivalents that may be included within its spirit and scope.

The invention claimed is:

1. An air cannon comprising:

a tank having opposite first and second openings and an interior chamber;

a valve rigidly and removably attached to the first opening;

a tube connecting the valve to the second opening of the tank through the interior chamber of the tank, the tube comprising a fluid passageway, the tube being removable from the tank through the first opening when the valve is removed from the first opening;

the valve being configured and adapted to selectively allow gas to pass from the interior chamber of the tank into the fluid passageway of the tube and out of the tank through the second opening and to selectively prevent gas from passing from the interior of the tank into the fluid passageway of the tube.

2. An air cannon in accordance with claim 1 wherein the tube is connected to a first fitting that is rigidly attached to the first opening and to a second fitting that is rigidly attached to the second opening.

3. An air cannon in accordance with claim 2 wherein each of the first and second fittings is a sleeve that encircles a portion of the tube.

4. An air cannon in accordance with claim 3 wherein at least one o-ring encircles the tube and is sandwiched between the tube and the sleeve of the first fitting and at least one o-ring encircles the tube and is sandwiched between the tube and the sleeve of the second fitting.

* * * * *